United States Patent [19]

Becherini

[11] Patent Number: 4,951,586

[45] Date of Patent: Aug. 28, 1990

[54] SEWING MACHINE ATTACHMENT FOR ALIGNING A REINFORCEMENT MEMBER IN A HEM

[75] Inventor: Albert E. Becherini, Germantown, Wis.

[73] Assignee: B&B Manufacturing, Inc., Milwaukee, Wis.

[21] Appl. No.: 325,233

[22] Filed: Mar. 17, 1989

[51] Int. Cl.[5] ..... D05B 35/00; D05B 3/12

[52] U.S. Cl. ..... 112/147; 112/121.15; 112/141; 112/121.27; 156/443

[58] Field of Search ..... 112/141, 147, 121.15, 112/121.27, 121.29, 262.3, 265.1; 156/443, 227

[56] References Cited

U.S. PATENT DOCUMENTS

| | | | |
|---|---|---|---|
| 3,898,941 | 8/1975 | Crawford et al. | 112/147 X |
| 4,357,197 | 11/1982 | Wilson | 112/121.15 X |
| 4,602,580 | 7/1986 | Schramayr | 112/121.27 X |

*Primary Examiner*—Andrew M. Falik

*Attorney, Agent, or Firm*—Foley & Lardner

[57] ABSTRACT

A hem folding attachment for folding a reinforcement member into the end of a strip of material prior to insertion of the folded end of the strip of material into a hem forming maching. The attachment including a frame or table having a guide mounted on the frame for aligning the strip of material on the table and a hem stop mounted on the frame for engaging the end of the strip of material. The reinforcement member is aligned on the top of the strip of material in a spaced relation to the hem stop. A folder bar is mounted on the frame beneath the strip of material for movement upwardly into engagement with the strip of material to fold the end of the strip of material around the reinforcement member. A shuttle is moved into engagement with the reinforcement member and folds the end of the strip over the top of the reinforcement member. The shuttle includes a clamp for engaging the reinforcement member prior to the movement of the shuttle transversely to feed the strip into the hem forming machine.

16 Claims, 7 Drawing Sheets

SEWING MACHINE ATTACHMENT FOR ALIGNING A REINFORCEMENT MEMBER IN A HEM

BACKGROUND OF THE INVENTION

1. Field of the Invention

The present invention relates to an automatic sewing machine attachment for positioning a hanger strip or weight in the hem of a vertical blind prior to stitching.

2. Description of the Prior Art

At the present time, fabric type vertical blinds are hemmed manually Typically, the hem is formed by hot melt glue, sonic welding, heat sealing, as well as sewing. Sonic welding or sewing are fairly sophisticated systems however, the steps of folding, loading, inserting or unloading of the hem in the vertical blind are still manually performed This can be time consuming and costly due to operator error resulting in rejection of the finished product.

The sewing process has been automated to the extent of providing a loading station for the vertical blind once the hem is folded which then automatically feeds the hem into the sewing head and the hem ejected upon completion. If a hanger is to be included in the top hem or a weight in the bottom hem, it must be inserted by hand by the operator prior to placing the hem in the loading station for the sewing machine. The edges of the hem must be closed by stitches or glue in order to retain the hanger or weight in the hem. Speed of operation, therefore, is dependent upon the dexterity of a particular operator.

SUMMARY OF THE PRESENT INVENTION

The present invention is directed to improvements in the technique for placing a hanger strip or weight in the hem of a vertical blind prior to the sewing operation. In general, in accordance with the present invention, once the strips for the vertical blind are cut to size and presented to the loading station, the hanger strips or weights are automatically positioned on the strip, the strip is folded to form the hem and the strip fed into the sewing machine to stitch the hem.

The hanger is retained in the hem by the interengagement of the hanger with the folded edge of the hem. The weight is retained in the bottom hem by the hem stitching.

One of the advantages of the present invention is the increased production capability as well as the increase in accuracy in the alignment of the hangers or weights in the hem.

Another advantage of the present invention is the elimination of the extra steps required.

Other objects and advantages of the invention will become apparent from the following detailed description when read in connection with the accompanying drawings.

DETAILED DESCRIPTION OF THE DRAWINGS

Figure 9:
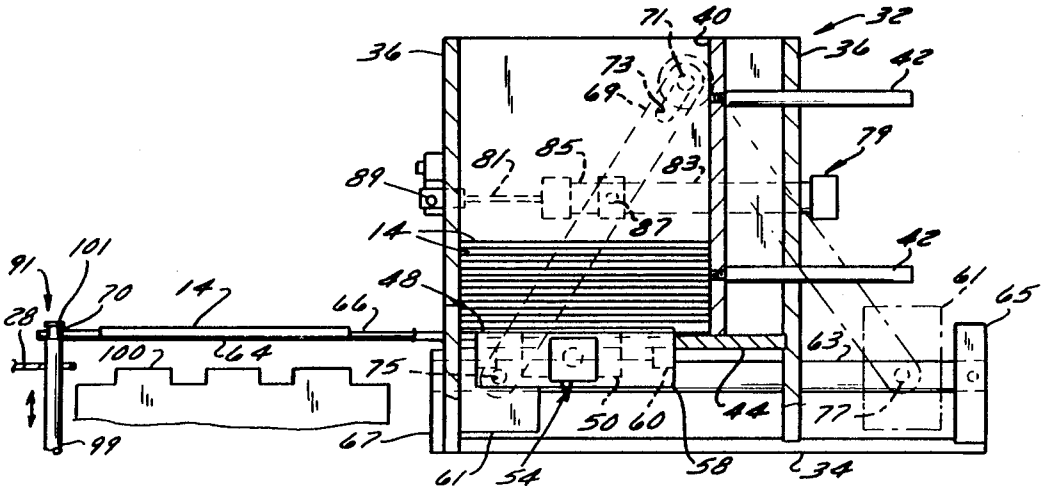

FIG. 9. is a front elevation view in section of the magazine.

Figure 9A:
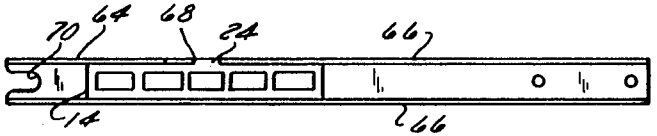

FIG. 9A is a plan view of the transfer blade with a hanger position in the blade.

Figure 10:
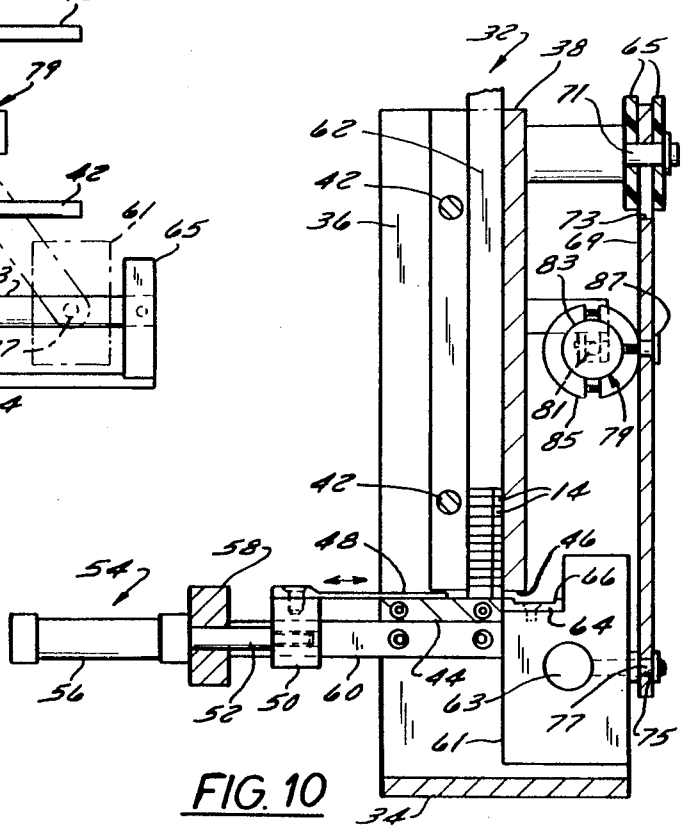

FIG. 10 is a side elevation view of the magazine in section showing the magazine discharge assembly.

FIGS. 11 through 19 are schematic views of the sequence of operation of the loading apparatus.

Figure 20:
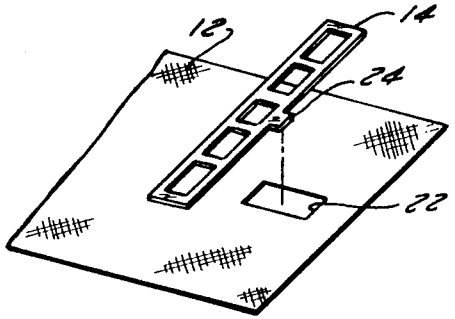

FIG. 20 is a perspective view of a portion of the end of the strip with a hanger aligned with the slot hemming the strip.

Figure 21:
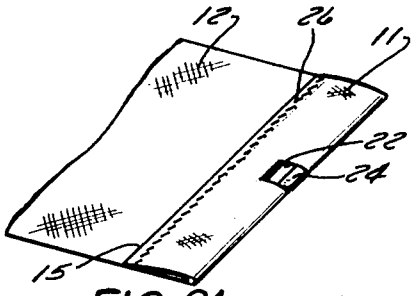

FIG. 21 is a perspective view of the hem with the hanger locked in the hem.

Figure 1:
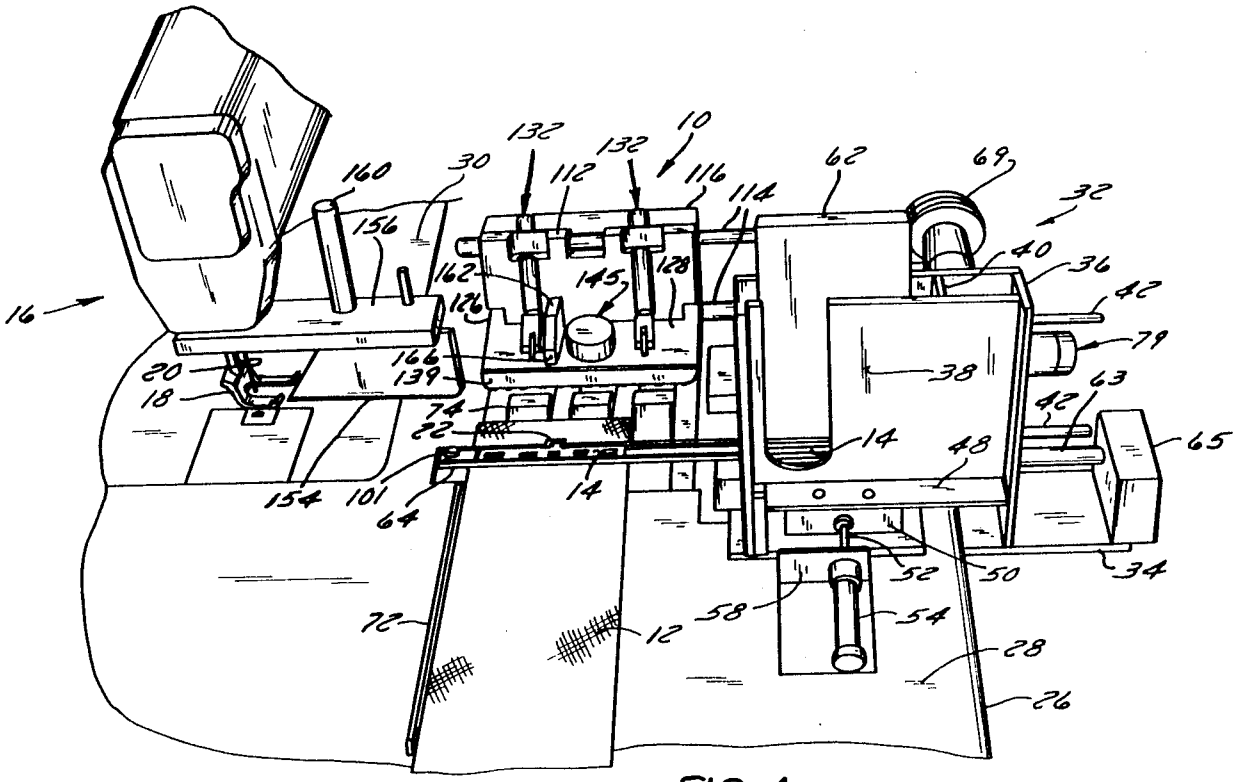
FIG. 1 is a perspective view of the general arrangement of the loading station with respect to the hanger magazine and the sewing machine.
Figure 22:
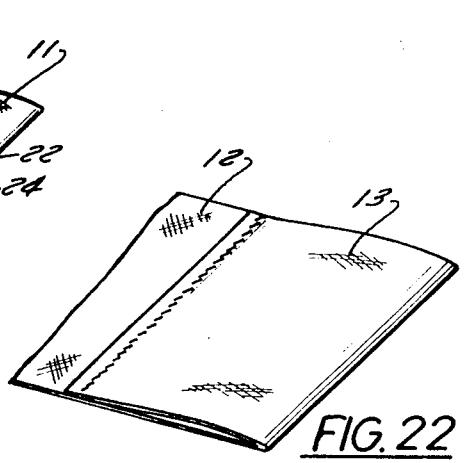

FIG. 22 is a perspective view of a bottom hem.

Before describing one embodiment of the invention in detail, it is to be understood that the invention is not limited in its application to the details of construction or the arrangement of components set forth in the following description and illustrated in the drawings. The invention is capable of other embodiments and can be practiced or carried out in various ways. Also, it is to be understood that the phraseology and terminology employed herein is for the purpose of description and should not be regarded as limiting.

DETAILED DESCRIPTION OF THE PREFERRED EMBODIMENT

The loading attachment 10, according to the present invention, is used to automatically form a hem at each end of a strip 12 of material for a vertical blind. The hem 11 at the top of the strip of material including a reinforcemennt member in the form of a hanger 14. The hem 13 at the bottom of the strip of material may also include a reinforcement member in the form of a weight 195. The strip 12 is transferred to a sewing machine 16 wherein the folded end 15 is stitched to the strip of material to join the hem. The sewing machine 16 is of a conventional design and includes a presser foot 18 for holding the folded end as the strip passes the needle 20. Although a sewing machine is described herein, the attachment 10 can be used in combination with other hem forming machines such as hot melt glue, sonic welding or heat sealing.

Referring to FIGS. 20 and 21, the end 15 of a a strip 12 of vertical material is shown having a slot 22 near the end of the blind. A top hanger 14 having a tab 24 is placed on the end of the strip 12 with the tab 24 aligned with the slot 22. The end 15 of the strip'12 is folded over to the position shown in FIG. 21 with the tab 24 projecting through the opening 22. As seen in FIG. 21, the hem is formed by the stitching 26 which is sewn across the folded end 15 of the strip 12. The tab 24 cooperates with the slot 22 to prevent the top hanger 14 from sliding out of the pocket formed in the end of the vertical blind as more particularly described hereinafter. In FIG. 22, a wide hem 13 is shown at the bottom of the strip 12 with the weight 195 having a tab 197 on one side that can be sewn into the bottom hem.

The attachment 10 generally includes a frame 26 having a plate 28 mounted thereon to form a table located in a coplanar relation with the table top 30 for the sewing machine 16. The top hangers 14 are stored on the plate 28 by means of a magazine 32. In this regard, the magazine 32 includes a base 34, a pair of end walls 36, and a pair of side walls 38. The top hangers 14 are aligned in the magazine by means of a adjustable wall 40 which is supported on end wall 36 by rods 42. The top hangers 14 are supported in the magazine on a base plate 44. The side walls 38 are spaced upwardly from the base plate 44 a distance corresponding to the thickness of the top hangers 14 thereby forming a slot 46 for discharge of the hanger strips from the magazine.

Means are provided for discharging the hanger strips from the magazine. Such means is in the form of a pusher plate 48 which is aligned with the slots 46 of the magazine. The plate 48 is mounted on a block 50 that is secured to the end of a piston 52 of a pneumatic piston and cylinder assembly 54. The cylinder 56 of the piston and cylinder assembly 54 is mounted on a cross block 58 which is supported on the magazine by plates 60. The top hangers 14 are biased to the bottom of the magazine by means of a weight block 62.

Means are provided for moving the hangers 14 from the magazine 32 to a position in alignment with the end of the strip 12. Such means is in the form of a blade 64 having ribs 66 along each edge of the blade 64 and a notch 70 at the end of blade 64. The hanger strips 14 are discharged from the magazine into the top of the blade 64 with the tab 24 aligned in a notch 68 in the rib 66. The rib 66 is tapered on one side of the notch 68 to allow the tab 24 to clear the notch 68 when the blade is pulled out of the hem. Means are provided for moving the blade across the plate 28. Such means is in the form of a block 61 which is mounted on a rod 63 supported at one end by a fixed plate 65 and at the other end by a plate 67 mounted on end wall 36. The block 61 is reciprocated on the rod 63 by a rocker arm 69 having a slot 73 at one end and an opening 75 at the other end. The rocker arm 69 is mounted for pivotal movement on a pin 71 which is mounted on plate 38 and aligned with slot 73. Bearing plates 65 are provided on pin 71 on each side of arm 69. The other end of the rocker arm 69 is connected to the block 61 by means of a pin 77 which is mounted on block 61 and aligned in opening 75.

The rocker arm 69 is reciprocated around pin 71 by means of a pneumatic piston and cylinder assembly 79 which includes a piston 81 and a cylinder 83. The cylinder 83 is mounted in a cylinder block 85 that is pivotally connected to the rocker arm by a pin 87. The piston 81 is connected to a pin 89 secured to the end wall 36.

The blade 64 is clamped into position on top of the end of the strip 12 by means of a clamp assembly 91 which engages the notch 70 by blade 64. In this regard, the clamp 91 includes a pneumatic piston and cylinder assembly 93 having a cylinder 95 mounted on a frame member 97 and a piston 99 having a cap 101 mounted on the end. The piston is aligned with slot 70 in the end of blade 64.

The strip 12 is aligned on the plate 28 by means of a guide 72 with the end of the strip engagement with a hem stop 74. The guide 72 is mounted for vertical motion on bracket 76. The guide is provided with a slot 78 at each end and is supported on the brackets 76 by means of pins 80 which are aligned with slots 78. The guide 72 is moved vertically by means of pneumatic piston and cylinder assembly 73 connected to the guide 72 and to a cross frame member 76A that is secured to brackets 76. The upward movement of the guide plate 72 is limited by means of pins 84 which engage the lower end of the slot 78 when the guide plate is moved upward.

The hem stop bar 74 includes a cross block 86 which is moved up and down by means of a pneumatic piston and cylinder assembly 90 having a piston 88 and a cylinder 92. The cross block 86 is mounted on the end of piston 88. The cylinder 92 is supported in a slide block 94 for horizontal movement to adjust the length of the hem on the vertical blind 12 as described hereinafter.

Figure 4:
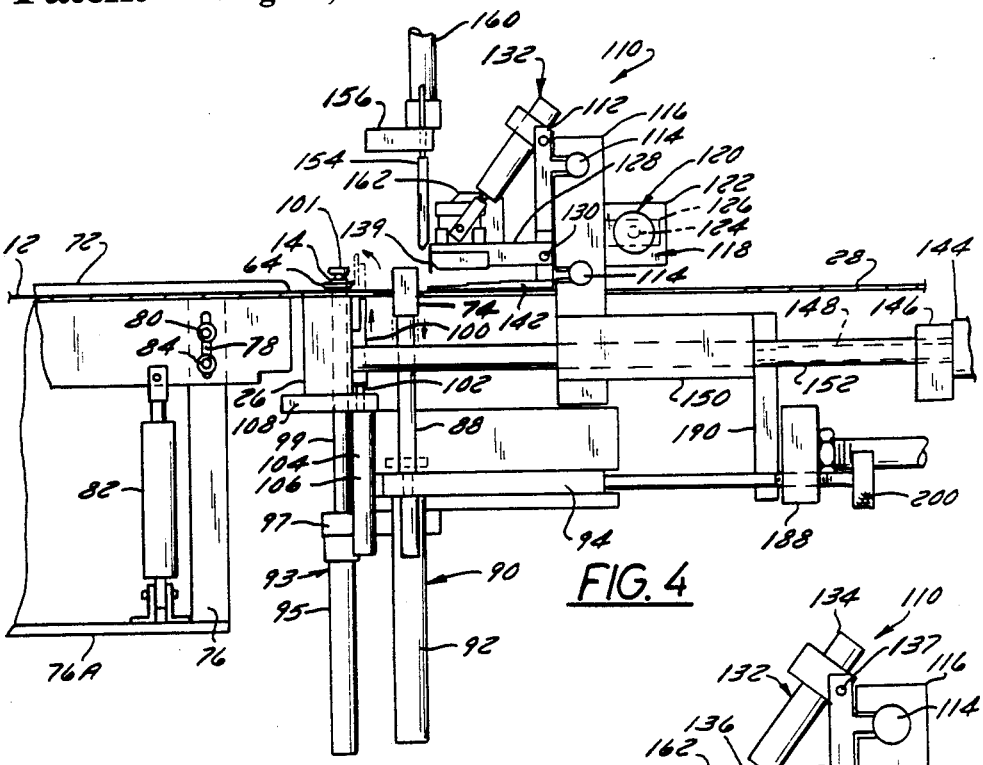
FIG. 4 is a side elevation view of a portion of the loading station showing the folder bar in the up position.
Figure 6:
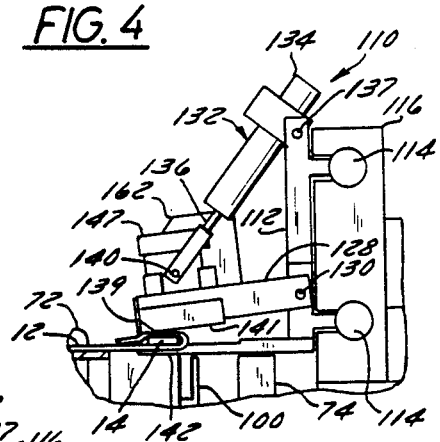
FIG. 6 is a view of the clamp shuttle with the wiper plate in the fold position.

The end 15 of the strip 12 is folded around the blade 64 by means of a folder plate 100, as seen in FIG. 4. The folder plate 100 is moved up and down by means of a pneumatic piston and cylinder assembly 104 having a piston 102 and cylinder 106. The cylinder 106 is secured to frame 108 and the piston 102 is connected to the folder plate 100. The hem stop 74 and folder plate 100 are withdrawn to a position below the plate 28 to allow the shuttle 110 (FIG. 5) to move in a position to engage the one end of the strip 12 folded around hanger 14.

Figure 8:
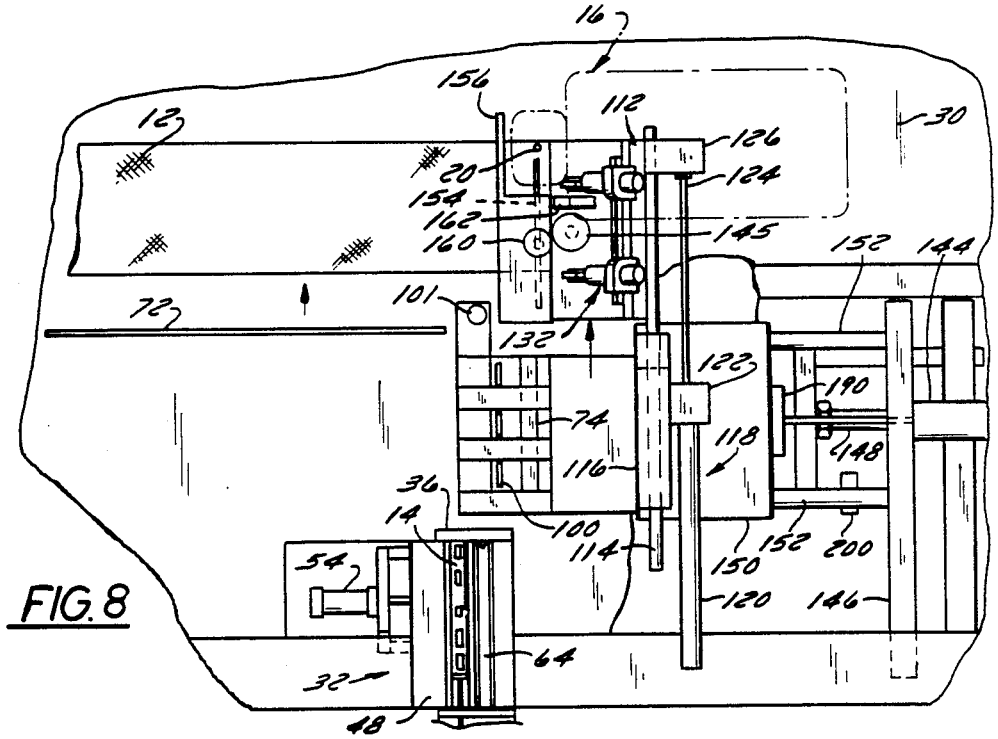
FIG. 8 is a plan view of a portion of the loading station showing the strip moved transversely into the sewing machine.

In this regard, the shuttle 110 includes a backing plate 112 which is supported on a pair of rods 114. The rods 114 are mounted for transverse movement with respect to the plate 28 by means of a fixed block 116. The backing plate 112 and rods 114 are moved transversely with respect to the fixed block 116 by means of a piston and cylinder assembly 118 having a cylinder 120 and a piston 124. The cylinder 120 is secured to a mounting block 122 on the back of the fixed block 116. The piston 124 is connected to a block 126 secured to the plate 112. With this arrangement the shuttle 110 can be moved from the position shown in FIG. 3 which is in alignment with the end of the strip 12 to the position shown in FIG. 8 with the strip 12 aligned with the sewing machine 16.

The folded end of the strip 12 is clamped in the shuttle 110 between a clamping plate 128 and a support plate 142. The clamping plate 128 is pivotally mounted on the backing plate 112 by means of pins 130. The support plate 142 is mounted on the backing plate 112. The clamping plate 128 is pivoted by means of a pair of pneumatic piston and cylinder assemblies 132 having cylinders 134 and pistons 136. The cylinders 134 are pivotally mounted on the upper end of the backing plate 112 by pins 137 and the pistons 136 are pivotally connected to the clamping plate 128 by pins 140.

The shuttle 110 is moved into engagement with the hem of the strip 12 by means of a piston and cylinder assembly 144 mounted on a cross plate 146 in the frame 26. The piston 148 of the piston and cylinder assembly 144 is connected to the slide block 150 which is secured to the block 116. The slide block 150 is mounted for horizontal motion on rods 152 that are secured to the main frame 26.

Figure 5:
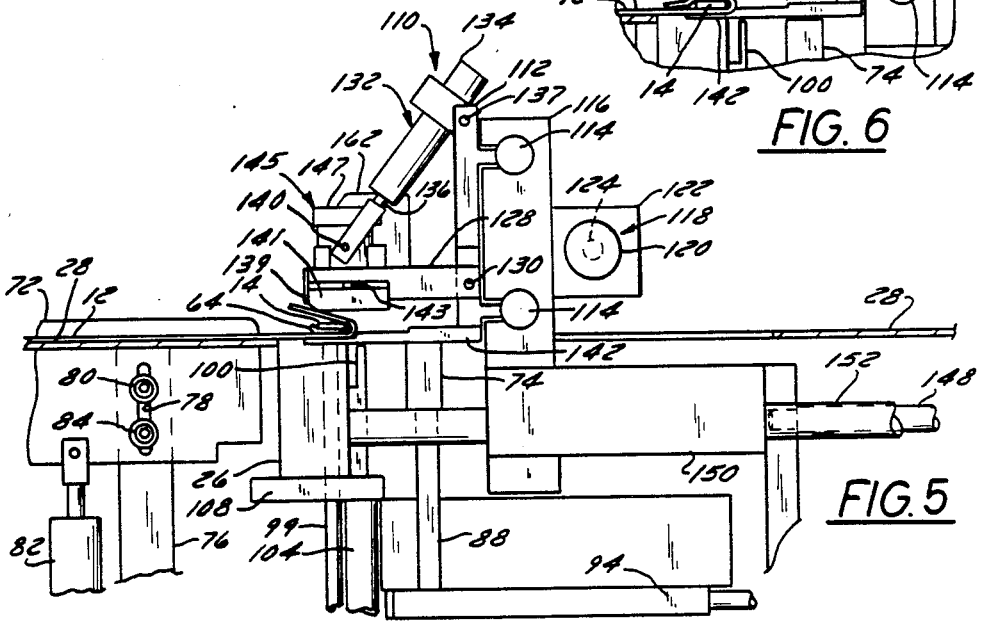
FIG. 5 is a side elevation view of a portion of the loading station showing the folder bar in the down position and the shuttle in a clamp position.
Figure 7:
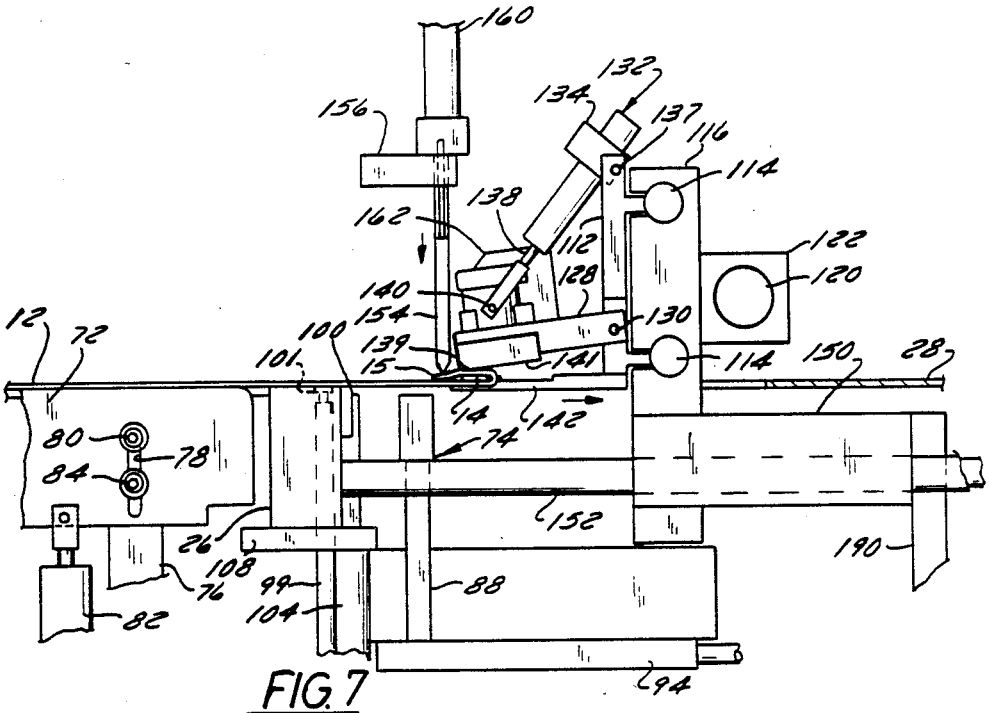
FIG. 7 is a side elevational view of a portion of the loading station showing the shuttle in the transverse position with the hold bar in the down position.

Means are provided on the clamp plate 128 for folding the end 15 of the strip 12 over the blade 64. Such means is in the form of a wiper plate 141 as seen in FIG. 5. The wiper plate 141 is supported on the clamp plate 128 by means of a piston and cylinder assembly 145 having a piston 143 and a cylinder 147. The cylinder 147 is mounted on the top of clamp plate 128 and the piston 143 is connected to the wiper plate 141.

Means are also provided on the clamp plate 128 for engaging the edge of the end 15 of the strip 12 when the clamp plate 128 is closed. Such means is in the form of a saw blade 129 mounted on the face of plate 128. The saw teeth will be embedded into the strip of material.

When the shuttle 110 is moved toward the sewing machine 16, the end 15 of the strip 12 moves under a hold down bar 154 which is mounted on the end of an arm 156 mounted on the sewing machine 16 and is aligned with the presser foot 18. The hold down bar 154 is moved downward to engage the end of the hem 15 by means of a piston and cylinder assembly 160.

Means are provided for moving the folding end of the strip 12 under the hold down bar 154. Such means is in the form of an air discharge assembly 162 mounted on the plate 128. The assembly 162 includes a block 164 having an outlet 166 which is directed downwardly toward the edge of the end of the strip. As the shuttle is moved toward the hold down bar 154, a blast of air is directed toward the the strip 12 to force the end downward under the hold down plate 154.

The forming of the hem as described above refers to the upper or top hem 11 of the vertical blind. If the loading attachment 10 is to be used for forming a hem at the lower end of the strip 12 for a weight 195, as shown in FIG. 22, the hem stop 86 and shuttle 110 are moved away from the folder bar 100 in order to increase the width of the hem 13. The weight 195 is provided with a tab 197 that is stitched into the hem when the strip is fed to the sewing machine. The adjustment of the hem stop 86 and shuttle 110 is made by means of a hem adjust piston and cylinder assembly 180 having a cylinder 182 and a piston 184. The cylinder 182 is mounted on a cross bar 186 on frame 26. The end of piston 182 is secured to a stop block 188 that is guided by rod 190 for horizontal motion with respect to cross bar 186. The piston 148, as noted above, is connected to slide block 150.

Figure 2:
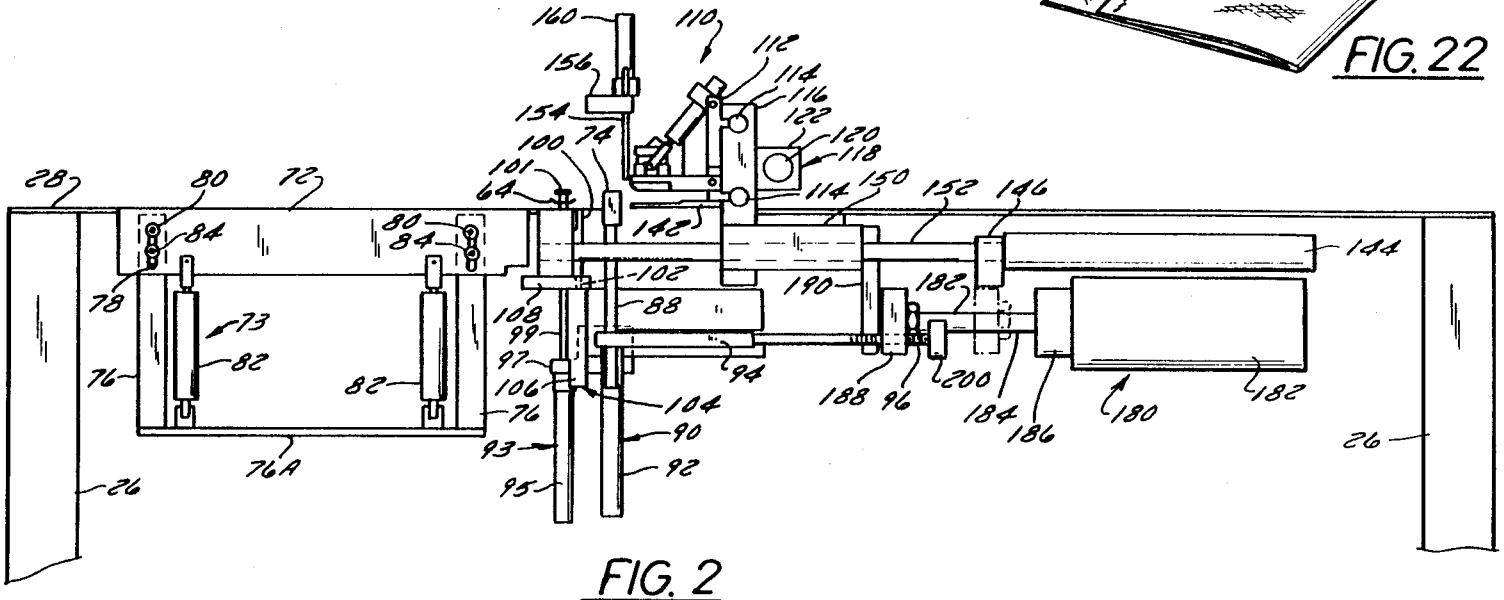
FIG. 2 is a side elevation view of the loading station.
Figure 3:
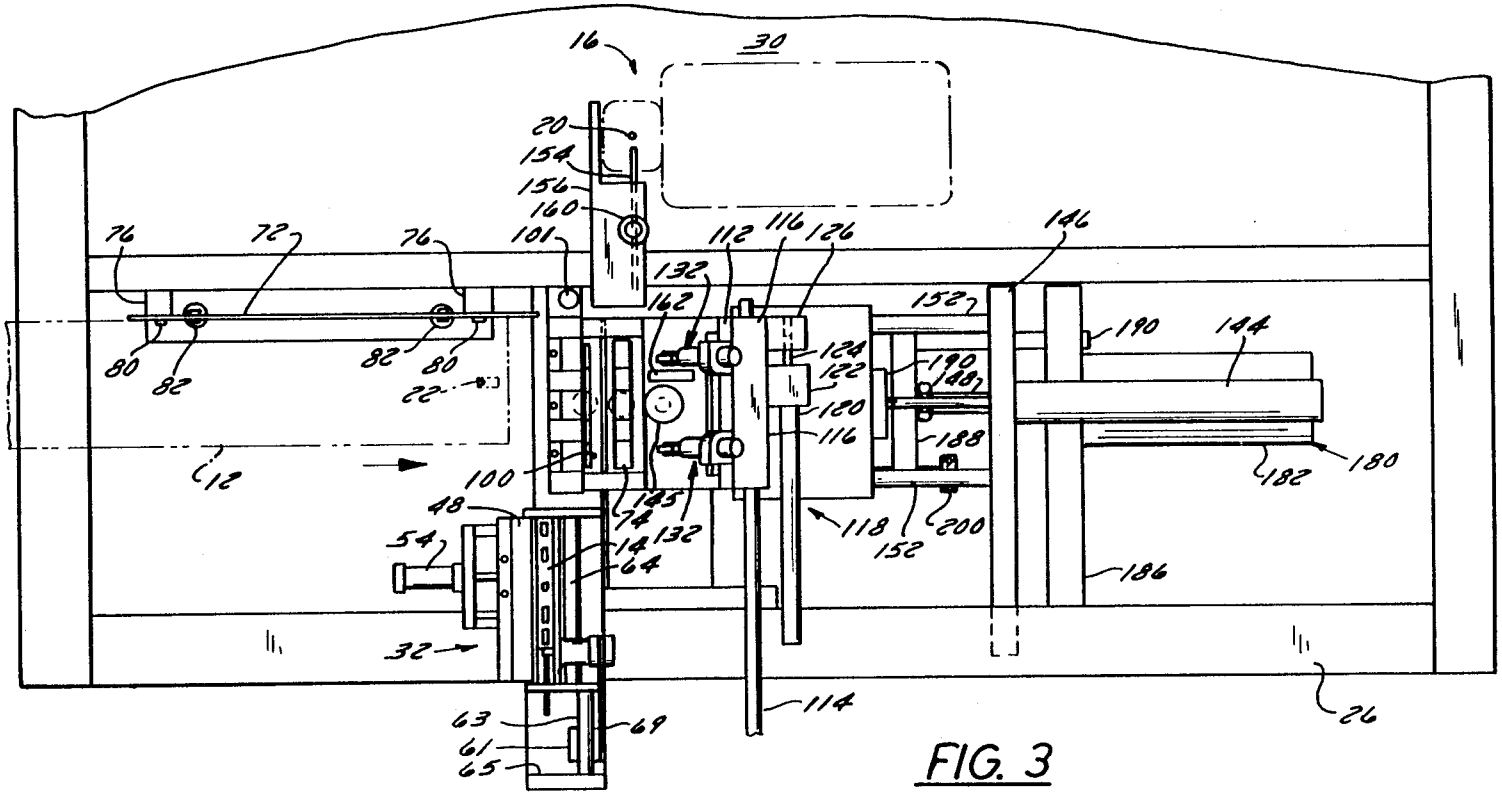
FIG. 3 is a top plan view of the loading station with the top plate removed.

As shown in FIGS. 2 and 3, the slide block 150 includes a plate 190 that depends vertically into the path of stop block 188. It should be noted that when piston 184 is drawn into cylinder 183 as shown in phantom in FIG. 2, the stop block 188 and hem stop 86 will also move with the end of piston 184. The shuttle cylinder 144 which is actuated at the same time moves the slide block 150 toward the cylinder 144 until the plate 190 engages the member 188. The shuttle 110, which is carried by the slide block 150, will move with slide block 150 to increase the width of the hem. The width of the hem can be adjusted by means of a thumb screw 200 mounted on pin 96 to more accurately adjust the width of the hem.

Sequence of Operation

The sequence of operation of the attachment 10 is shown in FIGS. 11 through 19. The steps of the sequence are as follows:

Step 1 (FIG. 11), a vertical blind strip 12 is positioned against the guide 72 in abutting relation to the hem stop 74.

Step 2 (FIG. 12), the blade 64 has been moved away from the magazine to carry a hanger 14 to a position where tab 24 is aligned with slot 22 in strip 12.

Step 3 (FIG. 13), the hold down clamp 91 is aligned with the slot 70 on the end of the blade 64.

Step 4 (FIG. 14), the clamp 91 is moved downward to hold the blade 64 against the strip 12; and the hem stop guide 74 is moved downward below shuttle 110 and the folder plate 100 is moved upward to fold the end 15 vertically with respect to the blade 64.

Step 5 (FIG. 15), folder plate 100 is moved downward and the shuttle 110 is moved toward the folded end of strip 12 to fold end 15 over the top of the hanger 14. The clamp 91 is released from the end of the blade 64 and the hanger blade 64 is pulled out of the hem. The hanger 14 is retained in the hem by the engagement of tab 24 with slot 22.

Step 6 (FIG. 16), the clamp 128 on the shuttle 110 is closed to hold the end 15 against the hanger 14.

Step 7 (FIG. 17), the guide 72 is moved downward and the shuttle 110 is retracted to pull the strip 12 and into alignment with the hold down plate 154.

Step 8 (FIG. 18), the shuttle 110 is moved transversely to move the folded end of the strip 12 under the plate 154. At the same time, air from the air assembly 162 may directed against the end 15 to force the edge of the end 15 under the hold down bar 54. The shuttle is moved transversely far enough to move the folded end under the presser feet 18 of the sewing machine which then automatically feeds the strip through the sewing machine to stitch the hem. It should be noted that the hanger 14 is retained in the hem by means of the engagement of tab 24 with the slot 22.

Figure 11:
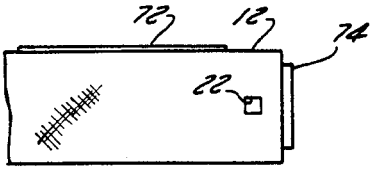
Figure 12:
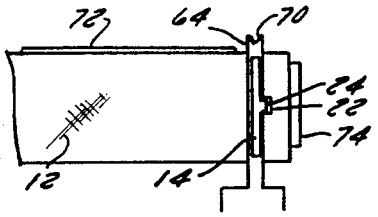
Figure 13:
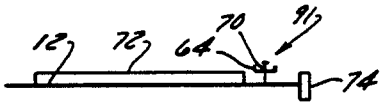
Figure 14:
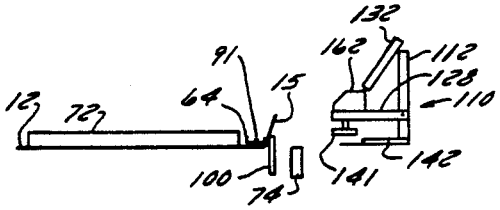
Figure 15:
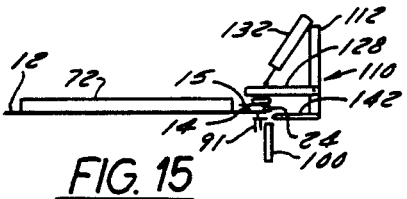
Figure 19:
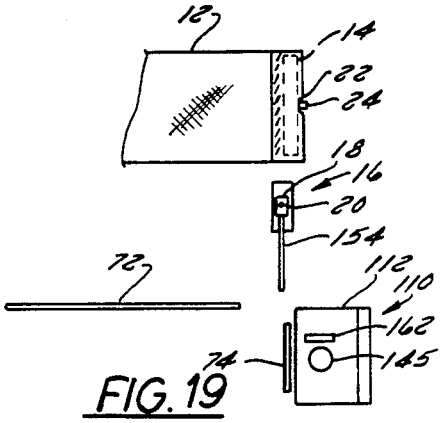
Figure 18:
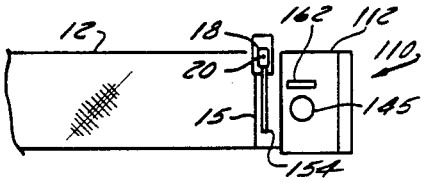
Figure 17:
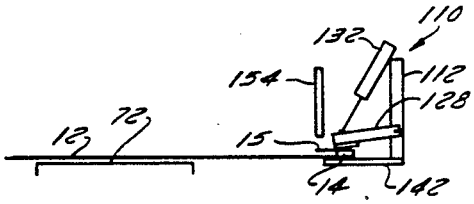
Figure 16:
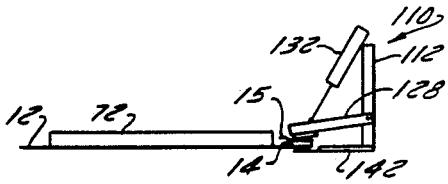

Step 9 (FIG. 19), as the strip is moved transversely into the sewing machine 16, the guide 72 is moved to its upper position and the hem guide 74 is moved into position to receive the next strip 12 of material. As the guide 72 is moved upward, the shuttle is returned to its initial position. The strip 12 can then be inserted into the assembly as shown in FIG. 11 to repeat the sequence of operation.

Thus, it is apparent that there has been provided, in accordance with the invention, a sewing machine attachment that fully satisfies the aims and advantages set forth above. When the invention has been described in conjunction with specific embodiments thereof, it is evident that many alternatives, modifications, and variations will be apparent to those skilled in the art. Accordingly, it is intended all such alternatives, modifications, and variations as fall within the spirit and broad scope of the appended claims.

The embodiments of the invention in which an exclusive property or privilege is claimed are defined as follows:

1. The combination of a sewing machine having a sewing surface and an attachment for aligning a reinforcement member in the hem of a strip of material prior to sewing the end of the strip of material to form the hem, said attachment comprising:

a frame having a surface coplanar with the surface of the sewing machine;

means mounted on said frame surface for holding a number of reinforcement members;

means mounted on said frame for aligning a strip of material with respect to the sewing machine;

means for engaging the end of said strip of material;

means for transporting one of said members from said holding means to a position on said strip of material and spaced from the end of said strip of material;

means for folding the end of the strip of material between said one of said members and said engaging means around the edge of said member;

a shuttle mounted for movement into engagement with the folded end of said strip, said shuttle including;

means for clamping the folded end of the strip of material over the top of said member; and means for moving said shuttle transversely toward the sewing machine wherein said folded end is stitched to the strip of material to enclose said member.

2. The attachment according to claim 1 wherein said aligning means comprises a guide bar mounted on said frame for movement from a position below said surface to a position above said surface to form a guide for one edge of said strip of material.

3. The attachment according to claim 1 including means mounted on said frame for adjusting the position of said engaging means and said clamping means whereby the width of said hem can be varied.

4. The attachment according to claim 1 wherein said folding means comprises a folder bar mounted on said frame for movement from a position below said strip to a position above said strip adjacent to said member whereby the end of said strip is folded around the edge of said member.

5. The attachment according to claim 1 wherein said shuttle includes a wiper plate for folding the end of said strip over the top of said member.

6. The attachment according to claim 5 including means mounted on said frame for adjusting the position of said engaging means and said shuttle whereby the width of said hem can be varied.

7. The attachment according to claim 6 including means on said shuttle for engaging the edge of the end of said strip when said strip is clamped on said shuttle.

8. The attachment according to claim 1 including means on said moving means for engaging the edge of the end of said strip when said strip is clamped on the shuttle.

9. A hem folding attachment for a hem forming machine comprising:

a frame having a top forming a work surface;

a guide mounted on said frame for aligning a strip of material on the work surface;

a hem stop mounted on said frame for engaging the end of the strip of material;

means mounted on said frame for aligning a reinforcement member on said strip in a spaced relation to the end of said strip;

a folder bar mounted on said frame beneath the strip of material;

means for moving said folder bar into engagement with the end of said strip between said member and said hem stop to fold said end around the edge of said member;

a shuttle mounted for movement into engagement with the folded end of said strip, said shuttle including a wiper plate for folding the end of the strip over said member and a clamp for clamping the folded end of the strip around said member; and means for moving said shuttle transversely with respect to said strip to feed the folded end of said strip into the hem forming machine to secure the folded end to the strip to form the hem.

10. The attachment according to claim 9 including a magazine mounted on said frame for supporting a plurality of said members, a blade for transporting said members from said magazine to said strip and a clamp assembly for holding said blade in a fixed position with respect to said strip.

11. The attachment according to claim 10 wherein said strip includes a slot located in a spaced relation to the end of said strip and said member comprises a hanger having a tab positioned to engage said slot when the end of said strip is folded around said hanger whereby said hanger is prevented from moving with respect to said strip.

12. The attachment according to claim 11 wherein said clamp includes a saw blade positioned to engage the edge of the folded end of said strip to prevent the folded end of the strip from moving when the strip is moved transversely by said shuttle.

13. A hem forming machine attachment for a sewing machine for forming a hem on the end of a strip of material with a reinforcement member enclosed in the hem, said attachment comprising:

a table;

a guide mounted on said table for aligning a strip of material on the table;

a hem stop mounted on said table to engage the end of the strip of material;

a magazine mounted on said table for holding a number of reinforcement members;

a blade for transferring a reinforcement member from said magazine to said strip of material;

a clamp mounted on said table for holding said blade in engagement with said strip and in a spaced relation to said hem stop;

a folder bar mounted on said table beneath said strip of material, said folder bar being moveable to a position above said strip to force the end of the strip between said blade and said hem stop around said blade;

a shuttle mounted on said table for movement into engagement with the folded end of said strip;

said shuttle including a clamp for engaging the folded end of said strip;

means for releasing said blade holding clamp from said blade whereby said blade can be removed from said strip;

means for moving said shuttle, transversely toward the machine for sewing said folded end of said strip to said strip to form the hem.

14. The attachment according to claim 13 wherein said reinforcement member is a hanger.

15. The attachment according to claim 13 wherein said reinforcement member is a weight.

16. The attachment according to claim 13 including means for moving said hem stop and said shuttle with respect to said folder bar to selectively vary the width of said hem.

* * * * *